US006289880B1

(12) United States Patent
Yamaguchi et al.

(10) Patent No.: US 6,289,880 B1
(45) Date of Patent: Sep. 18, 2001

(54) APPARATUS FOR DETECTING LEAKAGE OF VAPOR PURGE SYSTEM

(75) Inventors: Masahiko Yamaguchi, Obu; Masaaki Nakayama, Toyoake; Yasuo Mukai, Kariya, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/576,224

(22) Filed: May 22, 2000

(30) Foreign Application Priority Data

May 21, 1999 (JP) ..... 11-140942
Feb. 28, 2000 (JP) ..... 12-055981

(51) Int. Cl.[7] ..... F02M 37/04
(52) U.S. Cl. ..... 123/520
(58) Field of Search ..... 123/516, 510, 123/519, 520

(56) References Cited

U.S. PATENT DOCUMENTS 5,317,909 6/1994 Yamada et al. ..... 73/118.1
5,425,344 6/1995 Osuka et al. ..... 123/520
5,699,775 * 12/1997 Azuma ..... 123/520
6,082,337 * 7/2000 Fujimoto et al. ..... 123/520

FOREIGN PATENT DOCUMENTS 7-12014 1/1995 (JP) .

* cited by examiner

*Primary Examiner*—Thomas N. Moulis
(74) *Attorney, Agent, or Firm*—Nixon & Vanderhye P.C.

(57) ABSTRACT

A fuel vapor purge system has an apparatus for detecting leakage. The apparatus detects leakage based on a detected pressure in the tank. A remaining amount of fuel indicating a capacity of air in the tank and an introducing time of a negative pressure indicating an evaporated amount of fuel are taken into consideration of a detecting process. Therefore, the leakage detection is carried out accurately by compensating influences on the detected pressure by the remaining amount of fuel and an evaporated amount of fuel.

11 Claims, 9 Drawing Sheets

| Tx(s) \ Fu(ℓ) | 10 | 20 | 30 | 40 | 50 | 60 |
|---|---|---|---|---|---|---|
| 2 | --- | --- | --- | --- | --- | --- |
| 2.5 | --- | --- | --- | --- | --- | --- |
| 3 | --- | --- | --- | --- | --- | --- |
| 3.5 | --- | --- | --- | --- | --- | --- |
| 4 | --- | --- | --- | --- | --- | --- |

SMALL ← → LARGE

SMALL ↑ ↓ LARGE

APPARATUS FOR DETECTING LEAKAGE OF VAPOR PURGE SYSTEM

CROSS REFERENCE TO RELATED APPLICATION

This application is based on Japanese Patent Application No.Hei 11-140942 filed on May 21, 1999 and No.2000-55981 filed on Feb. 28, 2000, the contents of which are incorporated herein by reference.

BACKGROUND OF THE INVENTION

1. Field of the Invention

The present invention relates to an apparatus for diagnosing a fuel vapor purge system for an internal combustion engine of a vehicle. The apparatus diagnoses and detects leakage of the system.

2. Description of Related Art

JP-A-05-125997 discloses an apparatus for detecting leakage of a fuel vapor purge system. In this apparatus, a remaining amount of fuel in a tank is taken into consideration of a detection of leakage, because a pressure change in the tank is influenced by a capacity of air in the tank indicated by the remaining amount of fuel in the tank.

However, the pressure in the tank is also changed according to an evaporated amount of fuel after the purge system is hermetically closed.

SUMMARY OF THE INVENTION

The present invention addresses these drawbacks by providing an improved apparatus for detecting leakage of a purge system.

It is therefore an object of this invention to provide an apparatus having improved reliability of a detection of leakage of the purge system.

It is a further object of this invention to provide an apparatus accurately detects leakage of the purge system.

According to a first aspect of the present invention, a requirement for detecting leakage is corrected on the basis of both of an introducing speed of anegative pressure and a capacity of air in a tank. The introducing speed is represented by an introducing time of the negative pressure, a pressure change in a predetermined period of time or a changing rate of pressure. The capacity of air in the tank is represented by a remaining amount of fuel in the tank. The introducing speed indicates an evaporated amount of fuel. Therefore, it is possible to improve a detecting accuracy of leakage.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF PREFERRED EMBODIMENTS

Figure 1:
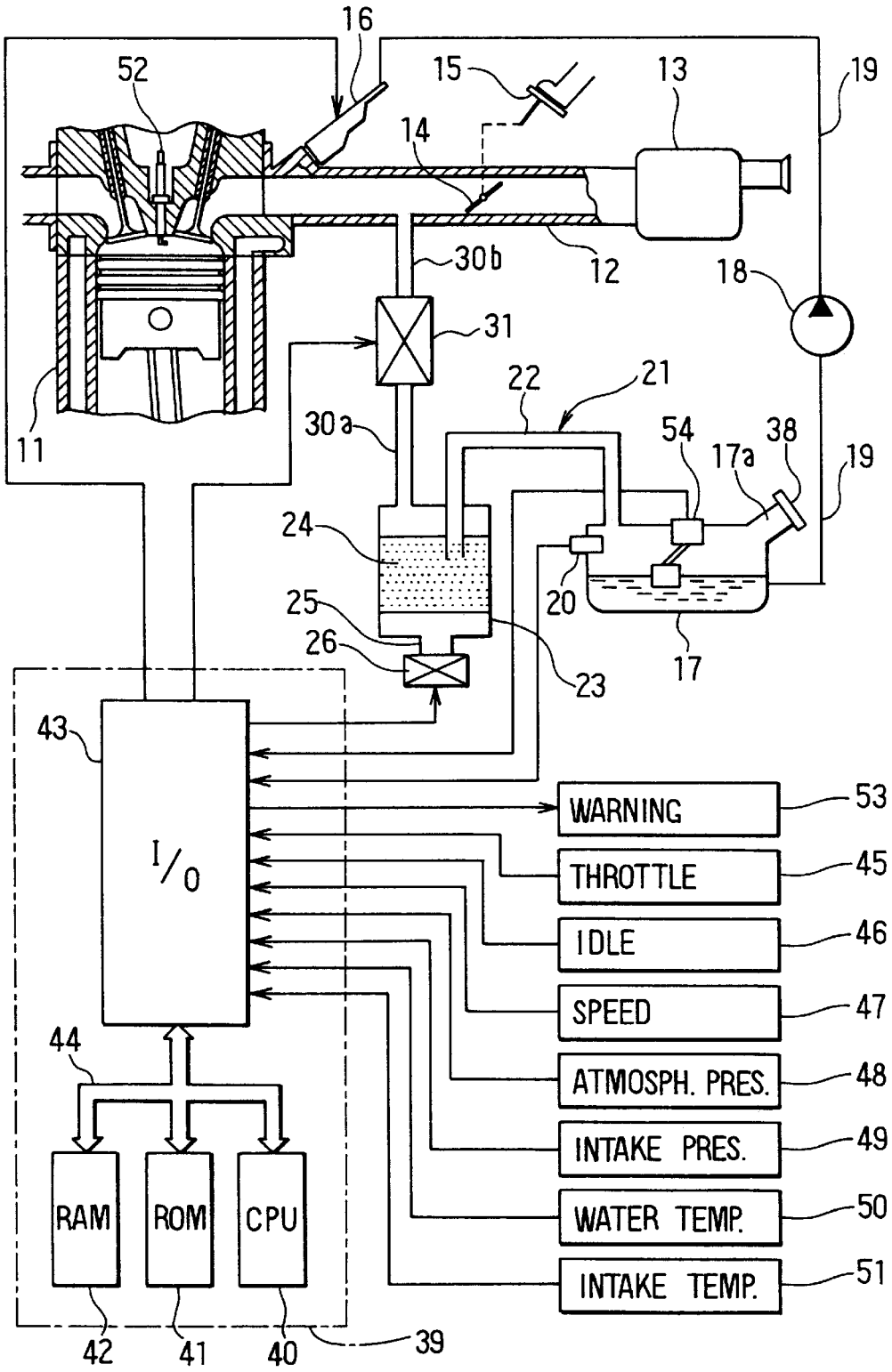
FIG. 1 is a schematic diagram of a fuel supply system for vehicle having a vapor purge system and a diagnosis apparatus of a embodiment of the present invention.

Referring to FIG. 1 to FIG. 6, a first embodiment of the present invention will be described. FIG. 1 shows an engine control system of a vehicle of the embodiment of the present invention. An air cleaner 13 is provided uppermost stream end of an intake pipe 12 of the engine 11. A throttle valve 14 is disposed in the intake pipe 12 for adjusting an amount of air introducing into the engine 11. The throttle valve 14 is connected with an accelerator pedal 15. Injectors 16 for injecting fuel are disposed in branch passages of the intake pipe 12 respectively. Fuel (gasoline) in the tank 17 is pressurized by a pump 18 and is supplied to the injectors 16 through a pipe 19. A pressure sensor 20 such as a semiconductor type is disposed in the tank 17 for detecting a pressure in the tank 17. A level sensor 54 for detecting a level of fuel is disposed in the tank 17 as a remaining amount detector for detecting a remaining amount of fuel in the tank 17.

A purge system 21 having a canister 23 is disposed between the tank 17 and the intake pipe 12. A connection pipe 22 is disposed to provide a connection between the tank 17 and the canister 23. The canister 23 contains an absorbent 24 such as an activated charcoal for absorbing a vapor of fuel. A pipe 25 for providing a communication to an atmosphere is disposed on a bottom of the canister 23. A canister valve 26 for controlling a communication of the pipe 25 is disposed in the pipe 25. The canister valve 26 is an electromagnetic valve, which is operated to close or open the pipe 25 in response to the signal. The canister valve 26 closes the pipe 25 when the signal is applied. Purge pipes 30*a* and 30*b* are disposed between the canister 23 and the intake pipe 12 to provide a passage for purging the vapor absorbed on the absorbent 24 to the intake pipe 12. A purge valve 31 such as an electromagnetic valve is disposed between the purge pipes 30*a* and 30*b*. The purge valve 31 is operated by a duty controlled pulse signal so that the purge valve 31 opens the passage in response to a duty ratio of the pulse signal. The purge valve controls a flow amount of the vapor from the canister 23 to the intake pipe 12. A fuel tank 17 has a filler neck 17*a* and a relief valve 38 integrated with a filler cap. The relief valve 38 regulates a pressure in the tank 17 within −40 mmHg to 150 mmHg. Therefore, the pressure in a section from the tank 17 to the canister 23 is maintained within the predetermined range.

Next, a control system is described. A control circuit 39 has a common bus 44 for connecting units of a microcomputer such as a CPU 40, a ROM 41, a RAM 42 and an I/O 43. The I/O 43 is connected to a plurality of sensors 45 to 51 for detecting operating conditions of the engine. A throttle sensor 45 detects an opening degree of the throttle valve 14. An idle switch 46 detects an idle position of the throttle valve 14 indicating an idle operation of the engine 11. A speed sensor 47 detects a speed of the vehicle. An atmospheric pressure sensor 48 detects an atmospheric pressure. An intake pressure sensor 49 detects a pressure in the intake pipe 12. A water temperature sensor 50 detects a temperature of a coolant of the engine. An intake temperature sensor 51 detects a temperature of an intake air. The ROM 41 and the RAM 42 store programs and data. The control circuit 39 outputs driving signals from the I/O 43 to actuators such as the injectors 16, an ignition system having spark plugs 52, the canister valve 26 and the purge valve 31. The control circuit 39 activates a warning means such as a lamp 53 when the malfunction is detected. The control circuit 39 executes engine controls such as an injection control, an ignition control, a vapor purge control and a diagnosis of the system 21 based on input signals and stored programs and data.

Figure 2:
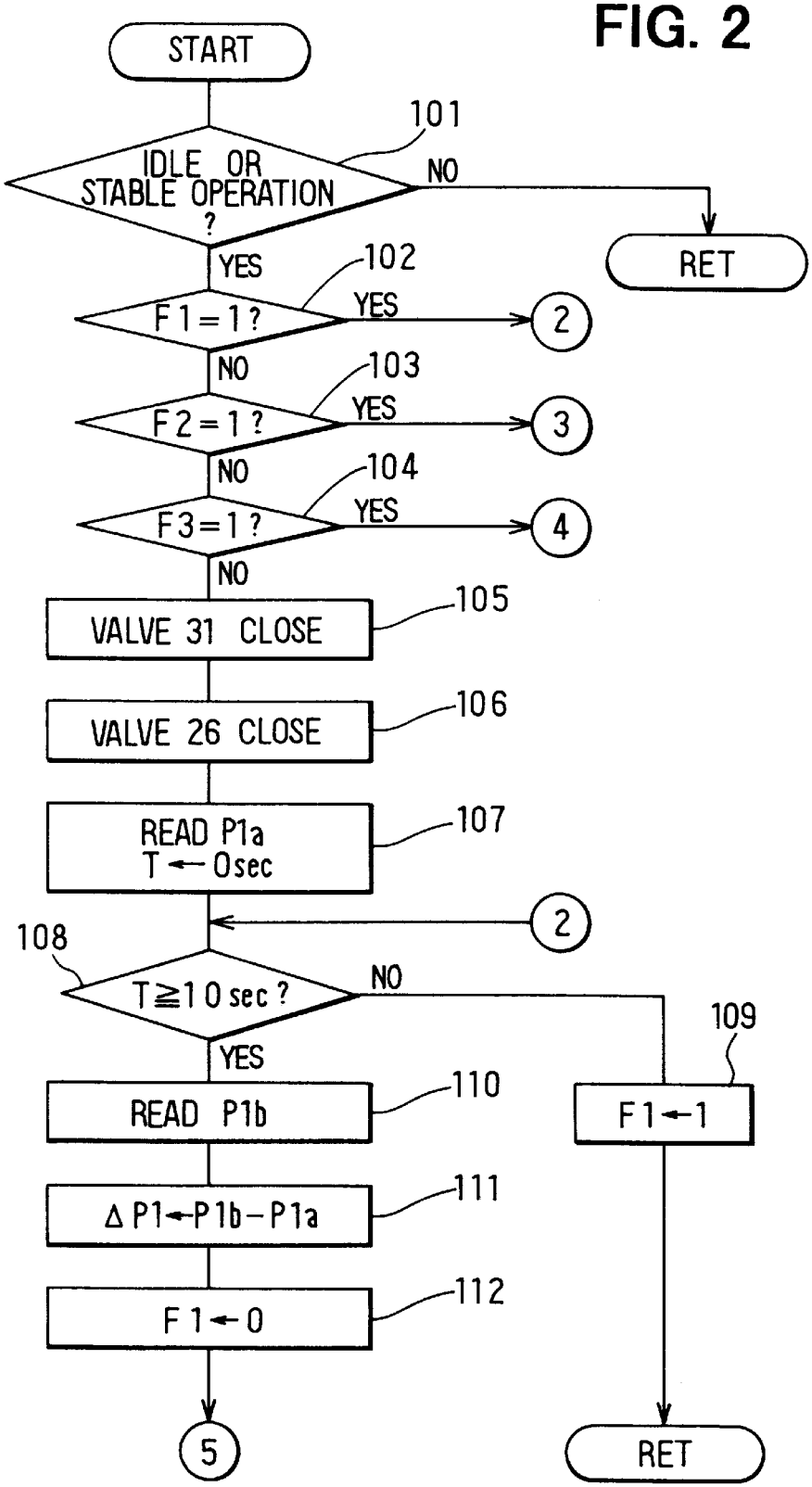
FIG. 2 and FIG. 3 are flow charts of a program for detecting leakage of the vapor purge system of a first embodiment of the present invention.
Figure 3:
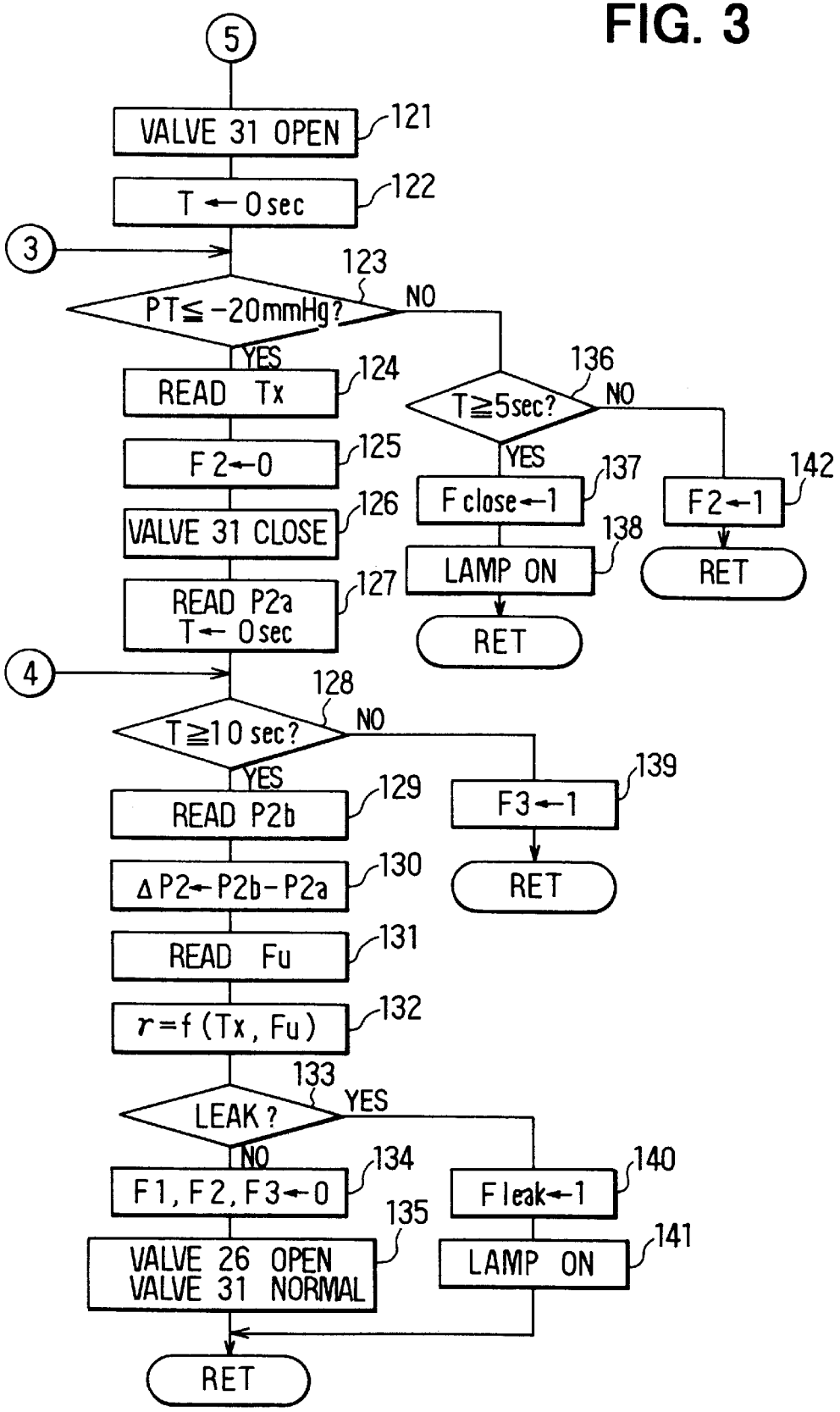

Referring to FIG. 2 and FIG. 3, a diagnosis program will be described. The program repeatedly runs every predetermined time intervals (for instance, every 256 (ms)) during an ignition switch of a vehicle is turned on, and acts as a leak detecting means.

At step 101, whether it is at least one of the idle operation and a stable operation or not is discriminated. In a case that it is not the idle or the stable condition, that is, it is a transient operation, the diagnosis is prohibited to prevent an incorrect result of the diagnosis by making no progress of the program.

In contrast, if the idle operation is detected at step 101, the program proceeds to steps 102 to 104. The program branches from these steps 102 to 104 according to a stage of a process of the program. The process includes four stages, which are indicated by three flags F1 to F3. When all the flags F1 to F3 indicate '0', it is a first stage, the program proceeds to step 105.

Figure 4:
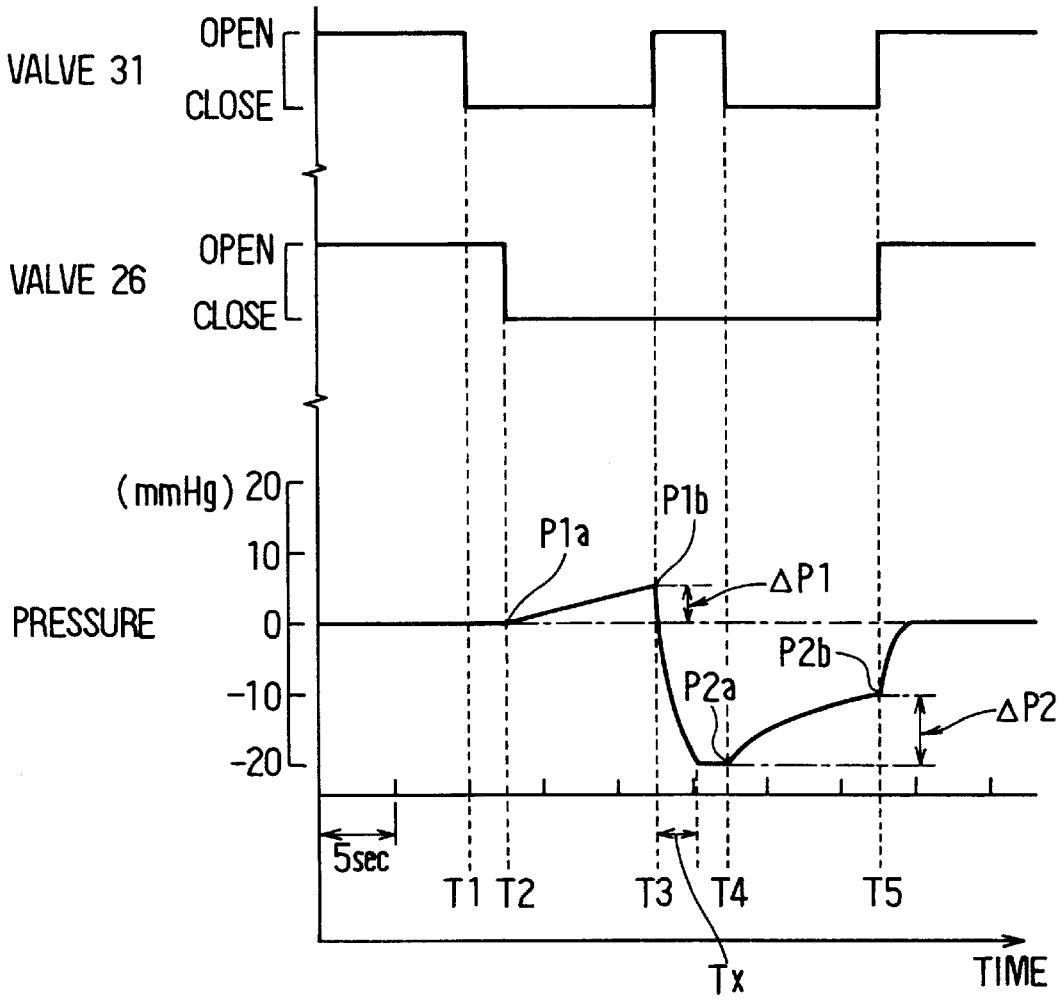
FIG. 4 is a graph showing conditions of components during a leakage detection.

In the first stage, first at step 105, the purge valve 31 is closed. For instance, as shown in FIG. 4, the purge valve 31 is closed at T1 even the canister valve 26 is opened. Therefore, pressure in the purge system 21 is maintained at the atmospheric pressure via the pipe 25. After that, at step 106, the canister valve 26 is closed to shut up the purge system 21. For instance, the canister valve 26 is closed at T2. Therefore, the closed purge system maintained at the atmospheric pressure is provided. Then, at step 107, the control circuit 39 reads and memorizes the detected pressure by the pressure sensor 20 as a pressure P1*a*, and initialize and starts a timer T at T2 of FIG. 4. Whether the timer T reaches a predetermined time, for instance 10 seconds, or not is discriminated at step 108. The first flag F1 is taken as '1' at step 109 before the timer T reaches 10 seconds.

After step 109, the program proceeds to the second stage. In the second stage, the program branches from step 102. In the second stage (T2 to T3), a detected pressure of the pressure sensor 20 rises from P1*a* (P1*a* is approximately 0 mmHg) according to an amount of the vapor and an amount of the remaining fuel. If the timer T reaches 10 seconds at step 108, then the process proceeds to step 110. At step 110, the control circuit 39 reads the detected pressure of the pressure sensor 20 and memorizes it as a pressure P1*b*. A pressure difference ΔP1 in a first measuring period (T2 to T3) is calculated by ΔP1=P1*b*−P1*a* at step 111. At step 112, the first flag F1 is taken as '0', the second stage is finished.

In the third stage, first at step 121 of FIG. 3, a negative pressure control is started. The purge valve 31 is operated into a full-open condition. Simultaneously, at step 122, a timer T is initialized and started. From this time (T3 in FIG. 4), a negative pressure in the intake pipe 12 is introduced into the purge system 21. Therefore, the detected value of the pressure sensor 20 is decreased, if the purge system 21 has no leakage. At step 123, whether the detected pressure in the tank 17 reaches a predetermined negative pressure, for instance −20 mmHg, or not is discriminated. In a case that the pressure reaches −20 mmHg, the process proceeds to step 136, whether it is elapsed a predetermined time, for instance 5 seconds, or not is discriminated by the timer T. The second flag F2 is taken as '1' at step 142 before the timer reaches 5 seconds, and the program is circulated through steep 103, 123 and 136. If the timer reaches 5 seconds, a flag Fclose is taken as '1', which indicates that the purge system 21 is blocked somewhere. At step 138, the control circuit 39 turns on the warning lamp 53 to warn a malfunction of the system 21 for a driver. On the other hand, in a case that the pressure decreases under −20 mmHg before the timer T reaches 5 seconds, the process proceeds to a branch of steps 124 to 127. In this branch, the control circuit 39 reads and memorizes a counted value of the timer T as an introducing time Tx. The above-mentioned steps 121 to 124 act as means for measuring an introducing rate of negative pressure. The memorized time Tx indicates an amount of the vapor evaporated during the negative pressure is introduced into the purge system 21. The second flag F2 is taken as '0' at step 125. At step 126, the purge valve 31 is closed at T4 of FIG. 4. At step 127, just after the step 126, the control circuit 39 reads and memorizes the detected pressure by the pressure sensor 20 as a pressure P2*a*, and initializes and starts the timer T. Thereby, the process moves from the third stage to the fourth stage.

Figures 5, 6:
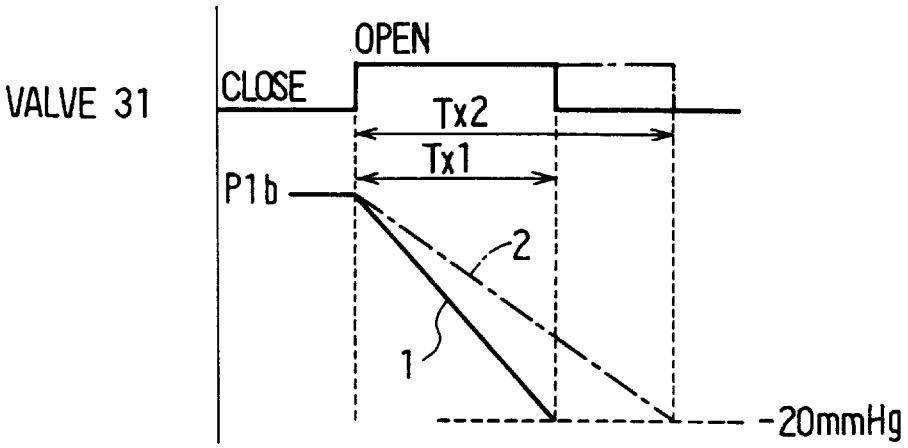
FIG. 5 is a graph showing a relationship between an evaporated amount of fuel and an introducing time.
FIG. 6 is a graph showing a map for calculating a correction value based on the introducing time and a remaining fuel.

After the steps 125 to 127, the pressure in the purge system 21 rises during T4 to T5. The pressure rises from 31 20 mmHg by a rate corresponding to a generated amount of the vapor and the remaining amount of fuel. At step 128, whether the timer T reaches a predetermined time, for instance 10 seconds, or not is discriminated. The third flag F3 is taken as '1' at step 139 before the timer T reaches 10 seconds. Therefore, the process jumps from step 104 to step 128. The control circuit 39 reads and memorizes the detected pressure at T5 of the pressure sensor 20 as a pressure P2*b* at step 129 after the timer T reaches 10 seconds. A pressure difference ΔP2 in a second measuring period (T4 to T5) is calculated by ΔP2=P2*b*−P2*a* at step 130. At step 131, the control circuit 39 reads the remaining amount of fuel detected by the level sensor 54 as a remaining amount Fu. A map memorized in the control circuit 39 as shown in FIG. 6 is searched for determining a correction value γ based on parameters such as the introducing time Tx and the remaining amount Fu. Therefore, the correction value γ reflecting the introducing time Tx and the remaining amount Fu is obtained. Here, the map shown in FIG. 6 is designed to optimize a detection of leakage. The correction value γ increases as the introducing time Tx becomes long, and increases as the remaining amount Fu increases (a space in the tank 17 decreased). Instead of the map in FIG. 6, a functional equation designed on the basis of experimentations and simulations can be used for calculating the correction value γ.

At step 133, an existence of leakage in the purge system 21 is discriminated by a requirement such as ΔP2>α·ΔP1+

β+γ. In this requirement, α is a coefficient for correcting a difference between the generated amount of the vapor in the atmospheric pressure and the negative pressure, β is a coefficient for correcting a detecting accuracy of the pressure sensor 20, leakage of the canister valve 26 or the like. The ΔP1 is a changed amount of pressure under atmospheric pressure and indicates a difference between a generated volume of vapor in the tank 17 and a lost volume passing through a leakage path. The ΔP2 is a changed amount of pressure under negative pressure and indicates a sum of a generated volume of vapor in the tank 17 and a volume flowing through the leakage path in the tank 17. Therefore, if there is the leakage path, the ΔP2 must be greater than the ΔP1.

In a case that the requirement in step 133 is not established, steps 134 and 135 are executed. At step 134, the flags F1, F2 and F3 are initialized. At step 135, the canister valve 26 is fully opened and the purge valve 31 is operated by normal control method.

In a case that the requirement in step 133 is established, steps 140 and 141 are executed. At step 140, a leakage flag Fleak is taken as '1' indicating an existence of leakage. At step 141, the control circuit turns on the warning lamp 53.

In this embodiment, the correction value γ is determined on the basis of the introducing time Tx and the remaining amount Fu. Therefore, it is possible to carry out the leakage diagnosis accurately.

In this embodiment, the generated amount of vapor is reflected on the detection of leakage at step 133 through the introducing time Tx used as a substitution of that. Therefore, a fuel temperature sensor and process for fuel temperature information are not necessary for detecting leakage. It is possible to prevent an influence by a difference of abilities of the evaporation depending on fuel can be suppressed.

In this embodiment, the detection of leakage is carried out when it is in the idle operation or the stable operation. Therefore, the introducing time Tx can be detected accurately by suppressing an influence of a change of the intake pressure.

Further, an influence of moving of a fuel level can be suppressed, when the detection of leakage is carried out only in the idle operation.

Figure 7:
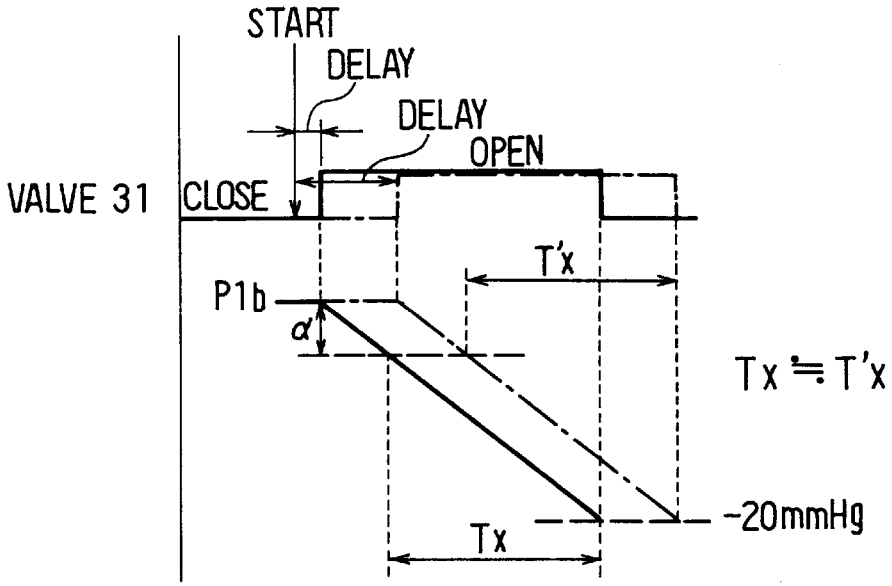
FIG. 7 is a graph showing another measuring method of the introducing time of a second embodiment of the present invention.

As shown in FIG. 7, the response delays from a start signal are different from each of the valves. The delays reflect on the introducing time Tx as an erroneous component. In the second embodiment, the introducing time Tx is measured from a point where a predetermined pressure response is detected. For instance, the measurement of the introducing time Tx is started at a point where the detected pressure is decreased a predetermined value α from the pressure P1*b*. Therefore, the difference of the delays depending on the valves is removed from the measured introducing time Tx.

Figure 8:
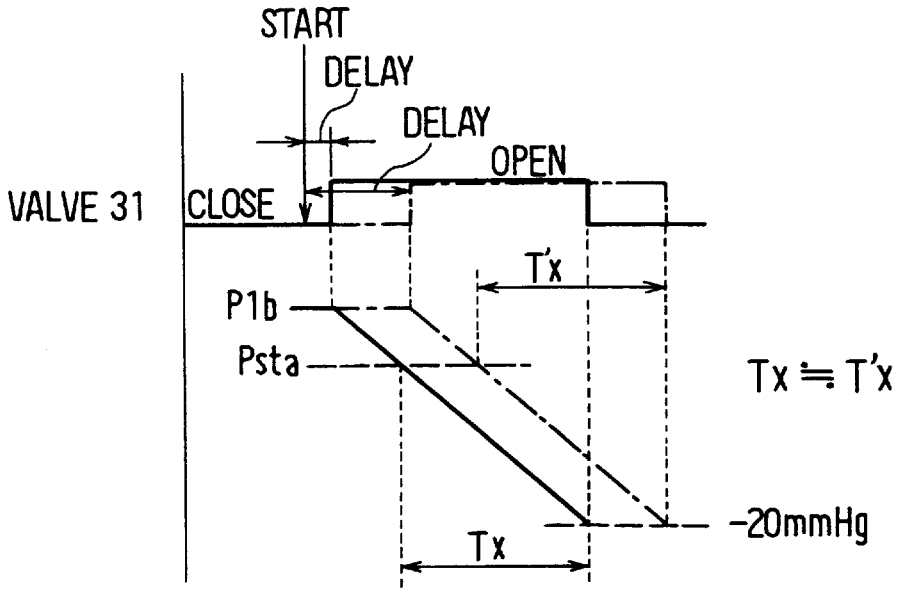
FIG. 8 is a graph showing still another measuring method of the introducing time of a third embodiment of the present invention.

As shown in FIG. 8, in a third embodiment of the present invention, the measurement of the introducing time Tx is started at a point where a predetermined value Psta. Therefore, the difference of the delays depending on the valves is removed from the measured introducing time Tx.

Figure 9:
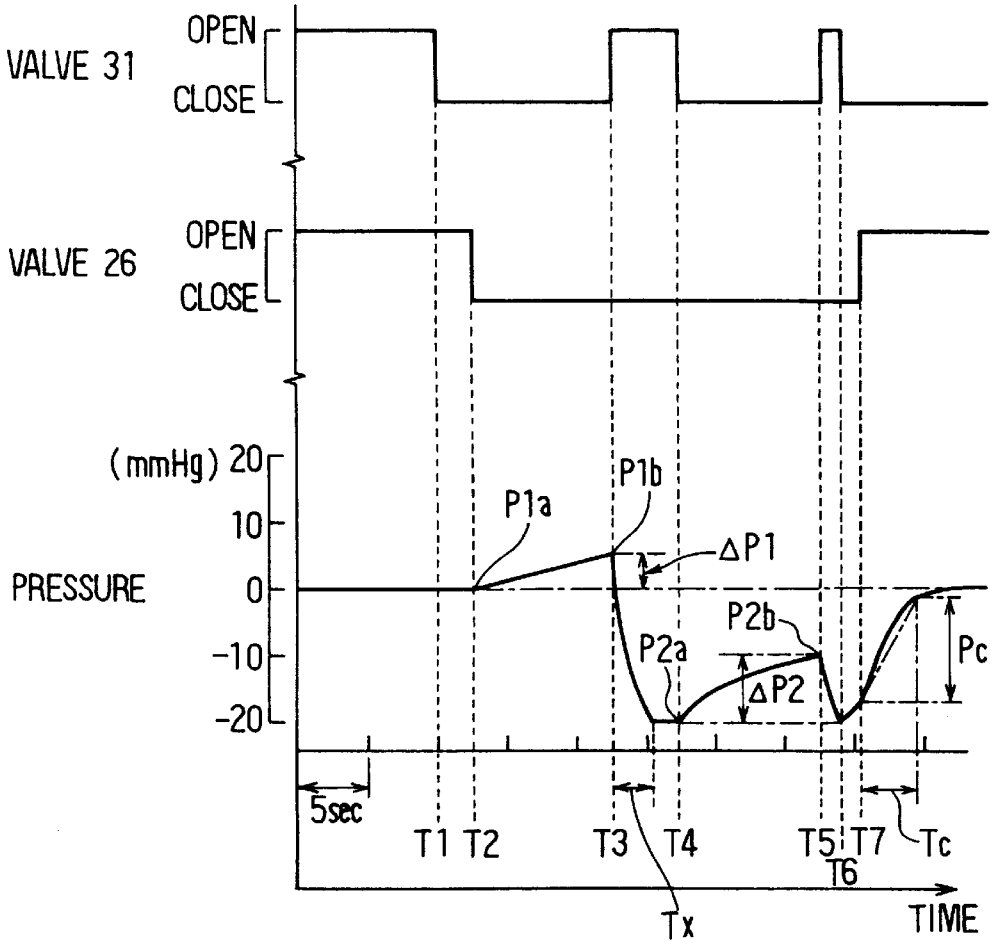
FIG. 9 is a graph showing another measuring method of the remaining amount of fuel of a fourth embodiment of the present invention.

As shown in FIG. 9, in a fourth embodiment of the present invention, a remaining fuel amount is presumed on the basis of an inclination of the pressure in the purge system 21 after the atmospheric pressure is introduced into the vacuumed purge system. The inclination of the pressure is substantially in proportion to an air capacity in the tank 17. For instance, the purge valve 31 is again opened for introducing the negative pressure at T5 in FIG. 9 after the pressure difference ΔP2 is detected. The purge valve 31 is closed at T6. The canister valve 26 is opened at T7 to introduce the atmospheric pressure into the purge system, 21. After that, the pressure change Pc/Tc is measured and the remaining amount of fuel is presumed from the pressure change Pc/Tc. This presumption process acts as the remaining fuel detecting means. It is possible to eliminate the level sensor 54, further to suppress an error depending on an inclination of the vehicle.

Figure 11:
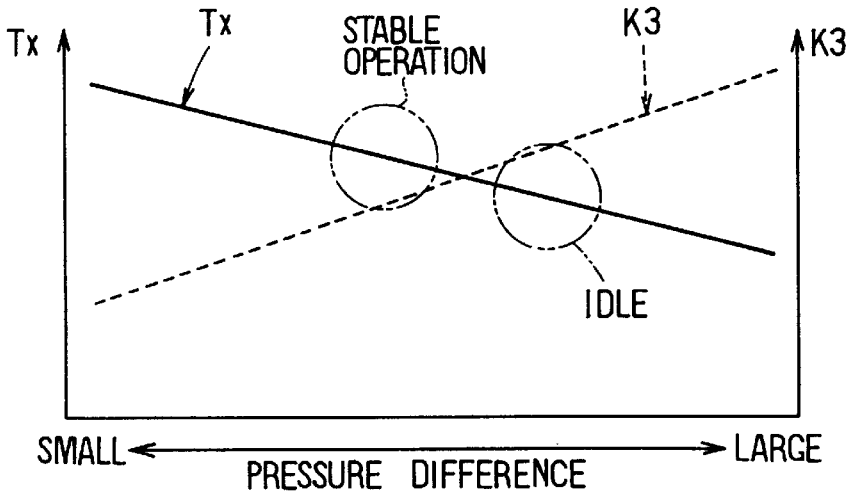
FIG. 11 is a graph showing a correcting method according to a pressure difference between the pressure in the tank and an intake pressure.
Figure 10:
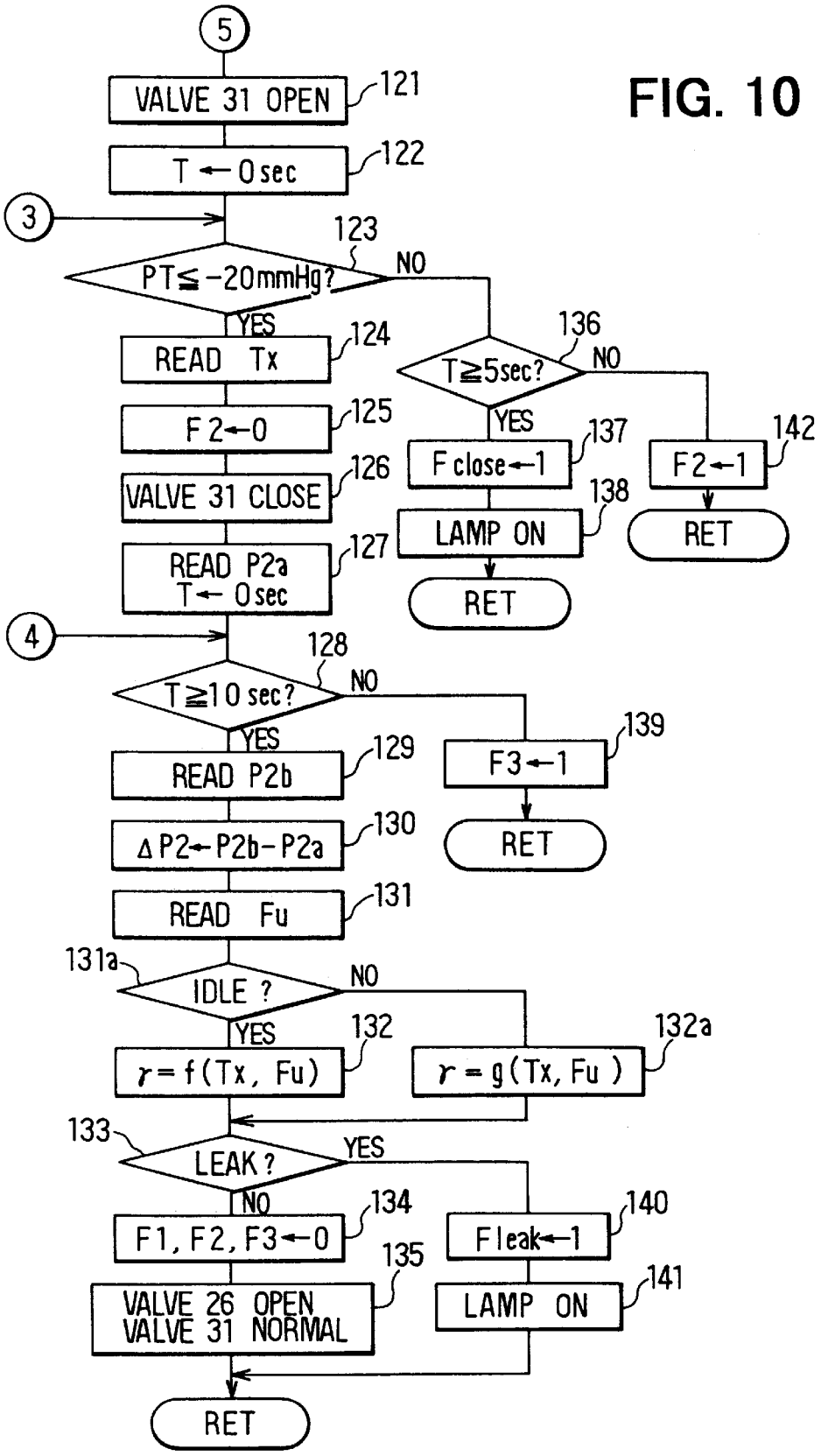
FIG. 10 is a flow chart of a program for detecting leakage of the vapor purge system of a fifth embodiment of the present invention.
Figure 12:
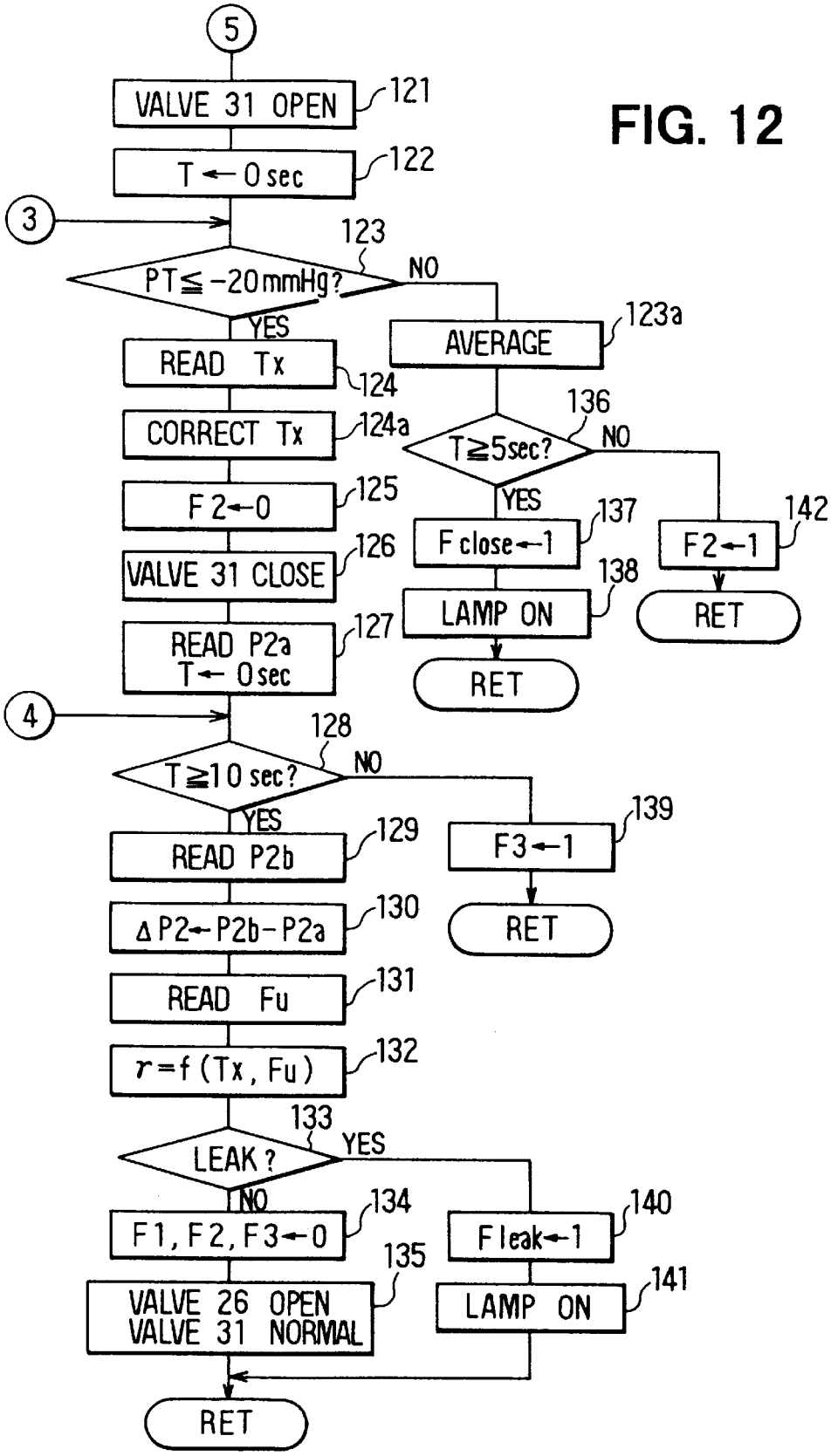
FIG. 12 is a flow chart of a program for detecting leakage of the vapor purge system of a sixth embodiment of the present invention.

In a fifth embodiment of the present invention, an influence by the intake pressure will be compensated. As shown in FIG. 11, the intake pressures at the idle operation and the stable running operation are different, and the difference influences on the introducing time Tx. Therefore, in the fifth embodiment, steps 131*a* and 132*a* are added on the program as shown in FIG. 10. in this embodiment, the correction value γ is determined on the basis of different functions f or g according to the decision at step 131*a*. In a case that it is in the idle operation, the correction value γ is determined on the basis of function f. On the other hand, it is in the stable operation, the correction value γ is determined on the basis of function g. Therefore, the intake pressure reflects on the leakage detection through the correction value γ according to the operating condition of the vehicle. Further, the calculation of the correction value γ may be changed according to the intake pressure directly. Further, an additional correction value F1 may be used for correcting the correction value γ. In a case that the correction is carried out by γ=f(Tx, Fu)×F1, the value F1 is decreased as the intake pressure is increased.

Further, a pressure difference Pd between the pressure in the tank 17 and the intake pressure may be taken into consideration of the determination of value γ. For instance, a map or a function may be defined as γ=f(Tx, Fu, Pd). Further, the value γ may be corrected by an additional correction value F2 according to the pressure difference Pd and γ=f(Tx, Fu)×F2. In this case, the value F2 is increased as the pressure difference Pd is increased. Therefore, an inclination of the introducing time Tx is compensated.

Further, the introducing time Tx may be corrected by an average value of the pressure difference Pd. In a sixth embodiment, steps 123*a* and 124*a* are added. At step 123*a*, an average value of the pressure difference Pd is calculated. At step 124*a*, the introducing time Tx is corrected by the average value. In this case, the correction coefficient K3 and Tx=Tx×K3 are used for correcting the introducing time Tx. As shown in FIG. 11, the coefficient K3 is increased as the pressure difference Pd is increased. Incidentally, the average value Pda can be calculated by a plurality of processes. For instance, the average value Pda may be calculated by Pda=Σ(δPi)/N. In this formula, δP is a pressure difference measured at a sampling timing, i is a subscript of a sampling timing and takes 1 to N and N is a total number of samplings. The average value Pda may be calculated by Pda=(Pdsta+Pdend)/2. In this formula, Pdsta is a pressure difference measured at a start of the measurement of the introducing time and Pdend is a pressure difference measured at an end of the measurement of the introducing time. The average value Pda may be calculated by Pda=Pta−Pia. In this formula, Pta is an average value of the pressure in the tank 17 and Pia is an average value of the pressure in the intake pipe 12.

Further, the average value Pda may be replaced by a pressure difference measured at an intermediate of the measurement of the introducing time Tx. For instance, a pressure difference may be measured when the pressure in the tank decreases half to a final value or a predetermined time has elapsed. Further, a pressure difference measured at a start or an end of the measurement of the introducing time Tx may be used.

Further, the introducing time Tx may be corrected by the intake pressure or a pressure difference between the intake pressure and the atmospheric pressure during the negative pressure is introduced.

Further, the introducing time Tx may be replaced by another parameter corresponding to an introducing speed of the negative pressure. For instance, a detected value or a decreased value of the pressure detected at a predetermined time has elapsed from a start of the negative pressure introduction may be used.

Further, a requirement for detecting leakage can be modified. For instance, leakage may be detected by whether a variable $VA=\Delta P2-\alpha\cdot\Delta P1$ is greater than a predetermined threshold value or not. In this case, the variable VA or the threshold value may be corrected by the introducing speed of the negative pressure and the remaining amount of fuel. Further, the variable VA or the threshold value may be corrected by the intake pressure or the pressure difference Pd.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. An apparatus for detecting leakage of a vapor purge system having a canister for absorbing a vapor of fuel from a tank, a purge valve for controlling an amount of the vapor purged to an intake pipe of an engine and means for discriminating an existence of leakage based on a pressure change in the purge system when the purge system is hermetically closed after a predetermined pressure is introduced, comprising:

means for measuring a parameter corresponding to an introducing speed of a predetermined pressure into the purge system; and means for detecting an amount of remaining fuel in the tank, wherein said leakage detecting means corrects a requirement for discriminating the existence of leakage based on both of said parameter of said introducing speed and said amount of remaining fuel.

2. An apparatus for detecting leakage of a vapor purge system according to claim 1, wherein said parameter of said introducing speed is an introducing time of a negative pressure to control a pressure in said purge system to a predetermined pressure or a changed amount of said pressure in said purge system or a changing rate of said pressure in said purge system when said negative pressure is introduced.

3. An apparatus for detecting leakage of a vapor purge system according to claim 1, wherein said parameter is measured on the basis of a measurement started from said pressure in said purge system is decreased a predetermined pressure from a pressure at a start of an introducing of a negative pressure.

4. An apparatus for detecting leakage of a vapor purge system according to claim 1, wherein said parameter is measured on the basis of a measurement started from said pressure in said purge system is decreased to a predetermined pressure after a negative pressure is introduced.

5. An apparatus for detecting leakage of a vapor purge system according to claim 1, wherein said parameter is measured at a stable operating condition of said engine or an idle operating condition of said engine.

6. An apparatus for detecting leakage of a vapor purge system according to claim 1, wherein said leakage detecting means includes means for correcting or modifying said requirement for discriminating the existence of leakage based on a pressure in said intake pipe when a negative pressure is introduced.

7. An apparatus for detecting leakage of a vapor purge system according to claim 1, wherein said leakage detecting means includes means for correcting or modifying said requirement for discriminating the existence of leakage based on a pressure in said intake pipe and a pressure in said tank when a negative pressure is introduced.

8. An apparatus for detecting leakage of a vapor purge system according to claim 1, wherein said leakage detecting means includes means for correcting or modifying said requirement for discriminating the existence of leakage according to a stable operating condition or an idle operating condition of said engine.

9. An apparatus for detecting leakage of a vapor purge system according to claim 1, wherein said leakage detecting means includes means for correcting a measured value of said parameter based on a pressure in said intake pipe when a negative pressure is introduced.

10. An apparatus for detecting leakage of a vapor purge system according to claim 1, wherein said leakage detecting means includes means for correcting a measured value of said parameter based on a pressure in said intake pipe and a pressure in said tank when a negative pressure is introduced.

11. An apparatus for detecting leakage of a vapor purge system having a canister for absorbing a vapor of fuel from a tank and a purge valve for controlling an amount of the vapor purged to an intake pipe of an engine, comprising:

means for controlling a pressure in said purge system to a predetermined pressure by introducing a negative pressure into said purge system and closing said purge system hermetically after said predetermined pressure is provided;

means for measuring a response of said pressure when said controlling means introduces said negative pressure;

means for detecting an amount of remaining fuel in the tank;

means for discriminating an existence of leakage based on a pressure change in said purge system when said purge system is hermetically closed; and means for correcting a parameter used at said discriminating means according to said response of said pressure and said remaining amount of fuel to compensate a difference of an evaporated amount of fuel and a difference of a capacity of air in the tank.

* * * * *

UNITED STATES PATENT AND TRADEMARK OFFICE

CERTIFICATE OF CORRECTION

PATENT NO. : 6,289,880 B1
DATED : September 18, 2001
INVENTOR(S) : Yamaguchi et al.

It is certified that error appears in the above-identified patent and that said Letters Patent is hereby corrected as shown below:

Title page,
Item [30], Foreign Application Priority Data, delete "12-055981" and insert -- 2000-055981 --.

Signed and Sealed this

Ninth Day of April, 2002

*Attest:*

*Attesting Officer*

JAMES E. ROGAN
*Director of the United States Patent and Trademark Office*